US007909182B2

(12) United States Patent
Maier-Hunke

(10) Patent No.: US 7,909,182 B2
(45) Date of Patent: Mar. 22, 2011

(54) SHEET MATERIAL DISPENSER

(75) Inventor: Horst-Werner Maier-Hunke, Iserlohn (DE)

(73) Assignee: Durable Hunke & Jochheim GmbH & Co. KG, Iserlohn (DE)

( * ) Notice: Subject to any disclaimer, the term of this patent is extended or adjusted under 35 U.S.C. 154(b) by 342 days.

(21) Appl. No.: 11/977,449

(22) Filed: Oct. 24, 2007

(65) Prior Publication Data

US 2008/0099500 A1 May 1, 2008

(30) Foreign Application Priority Data

Oct. 30, 2006 (DE) ..... 10 2006 051 733

(51) Int. Cl.
*A47F 7/14* (2006.01)

(52) U.S. Cl. ..... 211/55; 211/72; 211/50

(58) Field of Classification Search ..... 211/55, 211/52, 72, 73, 10, 11, 126.1, 126.13, 184, 211/192, 49.1, 50; 206/741, 745; 220/23.86, 220/23.83; 40/124, 124.2
See application file for complete search history.

(56) References Cited

U.S. PATENT DOCUMENTS

| | | | | |
|---|---|---|---|---|
| 1,706,307 | A * | 3/1929 | McCarthy | 211/55 |
| 1,821,960 | A * | 9/1931 | Brooks, Jr. | 206/750 |
| 2,257,536 | A * | 9/1941 | Roycroft | 211/126.1 |
| 2,909,287 | A * | 10/1959 | Galassi | 211/55 |
| 4,083,456 | A * | 4/1978 | Genn et al. | 211/55 |
| 5,085,328 | A * | 2/1992 | Evenson | 211/55 |
| 5,207,329 | A * | 5/1993 | Hwang | 206/555 |
| 5,582,305 | A * | 12/1996 | Howell et al. | 211/126.1 |
| 5,584,412 | A * | 12/1996 | Wang | 220/500 |
| 5,641,074 | A * | 6/1997 | Smed | 211/11 |
| 5,657,880 | A * | 8/1997 | Birnbaum | 211/50 |
| 5,915,571 | A * | 6/1999 | Czalkiewicz et al. | 211/55 |
| 6,170,677 | B1 | 1/2001 | Meltser | |
| 6,213,318 | B1 * | 4/2001 | Walker | 212/177 |
| 6,705,473 | B1 * | 3/2004 | Schlesinger | 211/50 |
| 6,929,117 | B1 | 8/2005 | Cohen | |
| 6,968,959 | B1 * | 11/2005 | Garvin | 211/50 |
| 6,991,307 | B2 * | 1/2006 | Hoenig | 312/348.3 |
| 2006/0131250 | A1 | 6/2006 | Richardson et al. | |
| 2008/0099498 | A1 * | 5/2008 | Maier-Hunke | 221/67 |
| 2008/0099500 | A1 * | 5/2008 | Maier-Hunke | 221/92 |
| 2008/0128319 | A1 * | 6/2008 | Noble Colin et al. | 206/745 |

FOREIGN PATENT DOCUMENTS

| | | |
|---|---|---|
| DE | G 91 12 506.5 | 1/1992 |
| EP | 1223049 | 7/2002 |

* cited by examiner

*Primary Examiner* — Janet M Wilkens
*Assistant Examiner* — Dan Rohrhoff
(74) *Attorney, Agent, or Firm* — Mark P. Stone

(57) ABSTRACT

A sheet material dispenser has at least two compartments (37) for accommodating sheet material, which are formed by module components which can be joined together and released again. In order to provide a sheet material dispenser which has at least one divisible module part for accepting sheet material, the module components include at least one tray (1) for accommodating the sheet material, at least one front plate (34) and at least one partition wall (2), the tray (1) consists of a rear wall (4), two side walls (5, 6) and an end wall (7) forming its lower end, and the tray (1) is provided with longitudinal slots (8) in the region of its rear wall (4) for the attachment of the partition wall (2), which has hooks (27) that can be inserted into the longitudinal slots (8), for dividing the tray.

22 Claims, 10 Drawing Sheets

SHEET MATERIAL DISPENSER

BACKGROUND OF THE INVENTION

The invention relates to a sheet material dispenser with at least two compartments for the accommodation of sheet material, in particular in the form of brochures, in which the compartments are formed by module components, which can be joined together and released again.

A sheet material dispenser of the above type is known, the module components of which provide accommodation for sheet material and have a rear wall and a front wall which are joined together by two side walls and an end wall. With the known sheet material dispenser the rear walls and the front walls of the module components are provided with means by which module components can be joined together. The use of a front wall with the described sheet material dispenser excludes the division of the module parts providing accommodation for the sheet material in order to accommodate sheet material in the sheet material dispenser, the width of which is smaller than the width of the tray.

SUMMARY OF THE INVENTION

The object of the invention is to provide a sheet material dispenser which has at least one divisible module part for accepting sheet material. This object is solved according to the invention in that the module components include a tray used for accepting sheet material, at least one front plate and at least one partition wall, that the tray consists of a rear wall, two side walls and an end wall forming its lower end and that the tray is provided with longitudinal slots in the region of its rear wall for the attachment of the partition wall, which has hooks that can be inserted into the longitudinal slots, and by means of which the said tray can be divided.

The sheet material dispenser according to the invention offers the advantage that with the said dispenser it is possible to employ one and the same tray for the orderly accommodation of sheet material of different widths.

It has been found to be particularly advantageous if the tray has in each case at least one protrusion directed towards the tray interior in the region of the edges of its two side walls facing away from its rear wall, that on the rear side of the rear wall of each tray at least two mountings are provided for accepting the protrusions of a further tray which can be joined to the tray and that a limit stop is provided for limiting the movement, directed parallel to the rear wall, of the trays which can be respectively joined together. A tray formed in this way can be joined to further trays without difficulty in order to configure in this manner a sheet material dispenser having several staggered trays which are arranged one behind the other.

If the partition wall is also equipped with protrusions directed towards the side walls of the tray, then these protrusions together with the protrusions of the side walls facilitate the connection of additional trays having a reduced filling volume, which similarly consist of a rear wall, two side walls and an end wall forming their lower end and the width of which essentially corresponds to the spacing between the partition wall and the respective side wall facing it.

For the user of a sheet material dispenser of the above type a module component kit is thus available which enables the construction of the sheet material dispenser to be adapted to the respective circumstances. Here too, the situation is favourable in that due to the use of trays which are open at the front side, the material expense for the manufacture of sheet material dispensers with several compartments is less than in cases in which module components are used with front walls.

In practice it is recommended for production and stability reasons that each side wall is provided with more than three protrusions and also the rear sides of the rear walls are fitted with a plurality of mountings, wherein the number of the mountings assigned to a row of protrusions does not necessarily have to be equal to the number of protrusions.

The spacing between the protrusions of the respective side wall and the mountings assigned to these protrusions is practically equally large.

The rear sides of the rear walls of the trays are provided with parallel guides in the vicinity of the side walls, of which the guides of the respectively rearmost tray can be used for the acceptance of components which facilitate setting up or hanging up the sheet material dispenser.

Further features and details of the invention can be taken from the dependent claims and the following description of an embodiment of the invention illustrated in the enclosed drawing. The following are shown:

DESCRIPTION OF THE BEST MODE FOR CARRYING OUT THE INVENTION

Figure 1:
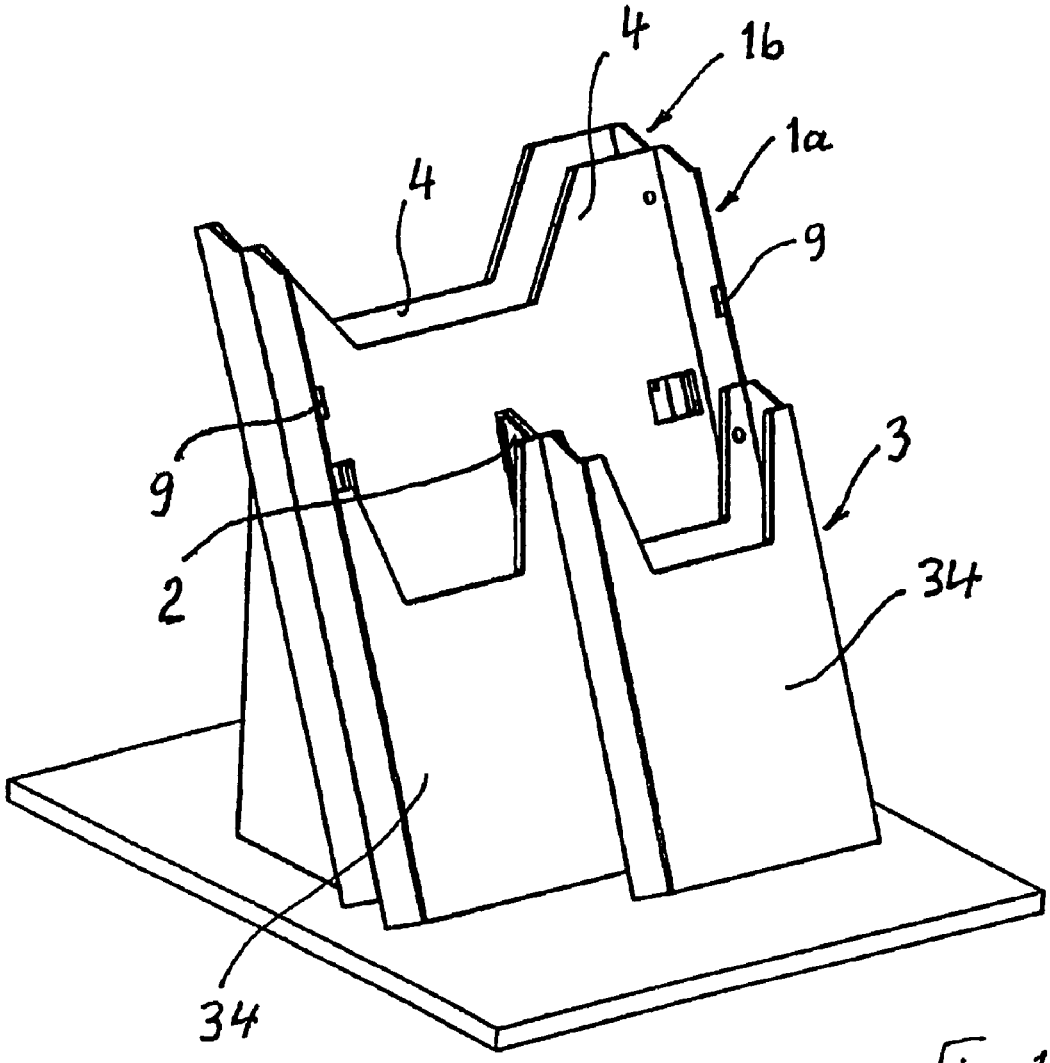
FIG. 1 a perspective view of a sheet material dispenser with two trays and an additional tray, FIG. 2 the perspective front view of a tray, FIG. 3 the perspective rear view of the tray according to FIG. 2, FIG. 4 the insertion of a component for setting up a sheet material dispenser on a table or similar object, FIG. 5 the insertion of the component illustrated in FIG. 4 for the case where suspension of the sheet material dispenser on a wall is desired, FIG. 6 the insertion of a partition wall in a tray, FIG. 7 the perspective front view of an additional tray, FIG. 8 the rear view of the additional tray according to FIG. 7, FIG. 9 an illustration corresponding to FIG. 4 for the case of a sheet material dispenser of additional trays, FIG. 10 an illustration corresponding to FIG. 5 for the case of a sheet material dispenser of additional trays, FIG. 11 the perspective view of fragments of two additional trays being joined together, FIG. 12 the front view of a front plate, FIG. 13 the rear view of the front plate according to FIG. 12, FIG. 14-17 the configuration of a sheet material dispenser, FIG. 18 a section through the sheet material dispenser according to FIG. 17 and FIG. 19 a particularly simple embodiment of a sheet material dispenser.
Figure 2:
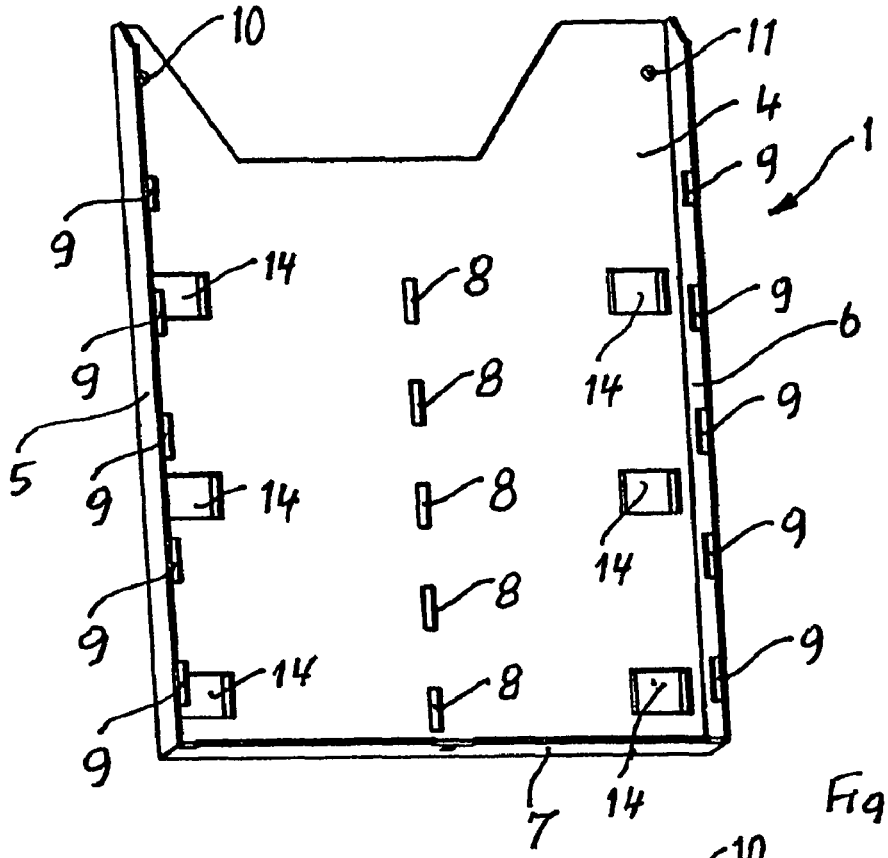
Figure 3:
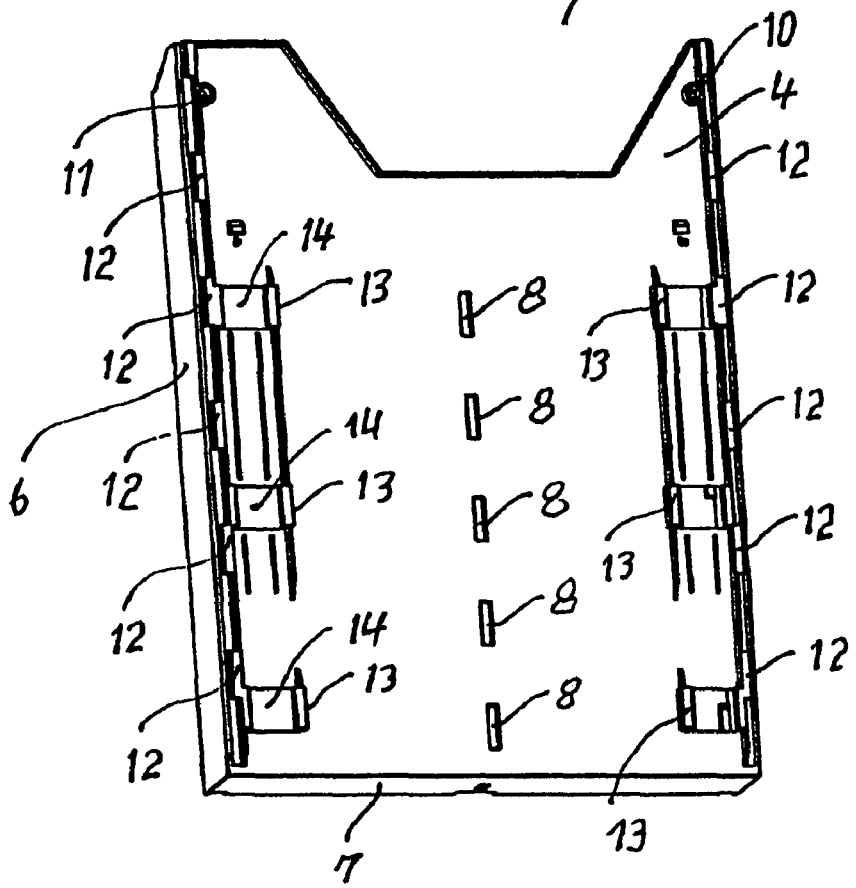

In FIG. 1, designated with 1*a* and 1*b*, two trays are arranged staggered, of which the front tray 1*a* is divided by a partition wall 2 into two parts each forming one compartment for a smaller sheet format. The right side of the sheet material dispenser is also provided with a tray, which is similarly intended for the accommodation of sheet material of a smaller format and is designated as the additional tray 3 in the following to differentiate it from the larger tray 1. Details of the construction of the trays 1 can be taken from FIGS. 2 and 3, of which FIG. 2 shows the front side and FIG. 3 the rear side of a tray 1. Each tray 1 has a rear wall 4, two side walls 5 and 6 as well as an end wall 7. In the centre of the trays 1 there are longitudinal slots 8 for accepting a partition wall 2. The side walls 5 and 6 of the trays 1 are, in the region of their edges facing away from the rear wall 4, provided with lug-shaped protrusions 9 which protrude into the interior of the tray 1. 10 and 11 are holes, which facilitate a direct mounting of the tray 1 on a wall.

On the rear side of its rear wall the tray 1 has receptacle-shaped mountings 12, which accommodate the protrusions 9.

Figure 4:
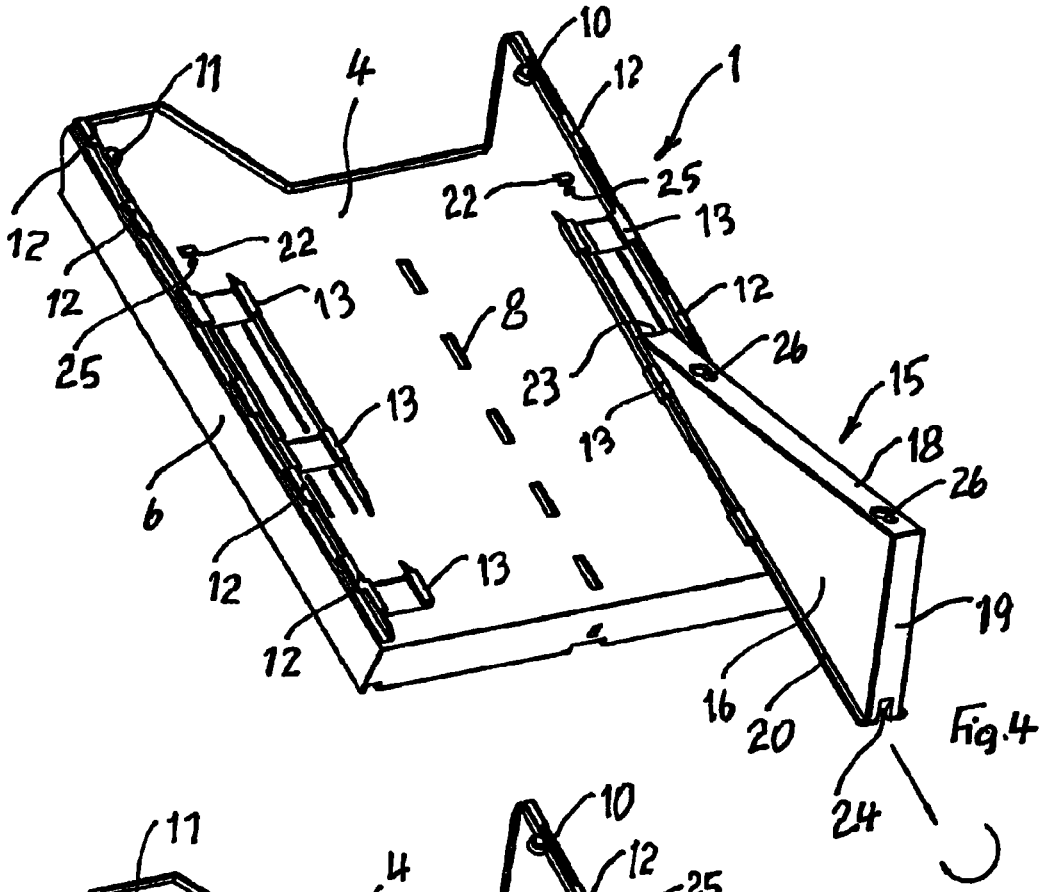
Figure 5:
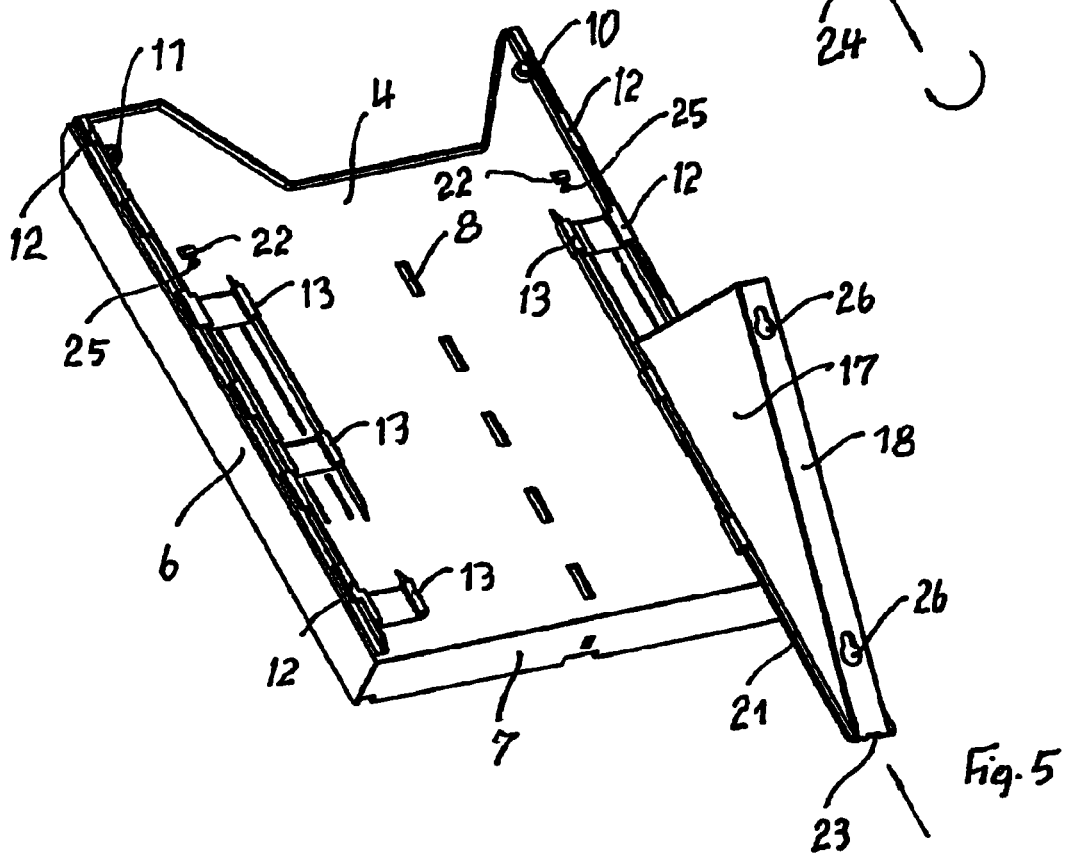

The rear wall 4 is also provided with guides 13, which are formed from L-shaped protrusions arranged in pairs. For reasons of injection moulding, in the region of the guides 13 there are recesses 14 in the rear wall 4. As illustrated in FIGS. 4 and 5, the guides 13 are used to accommodate components 15, with the aid of which the sheet material dispenser can be set up on a table or other support or also hung in a sloping position on a wall. The components 15 have two side walls 16, 17 arranged spaced from one another in the form of right-angled triangles, which are joined together in the region of the limbs of the triangles by transverse walls 18, 19 and which in the region of the hypotenuse of the triangle are provided with guide strips 20, 21, which can be pushed into the guides 13. Limit stops 22 on the rear side of the rear wall 4 together with the counter stops 23, 24 on the components 15 limit their insertion path. The arrangement of the components 15 in the vicinity of the side walls 5, 6 of the respective rearmost tray 1 increases the resistance of the set-up sheet material dispenser to tilting. Immediately below the limit stops 22 there are latching dips 25, which hold the components 15 in the inserted position. To facilitate the sloping suspension of the sheet material dispenser, the transverse wall 18 is provided with holes 26.

Figure 6:
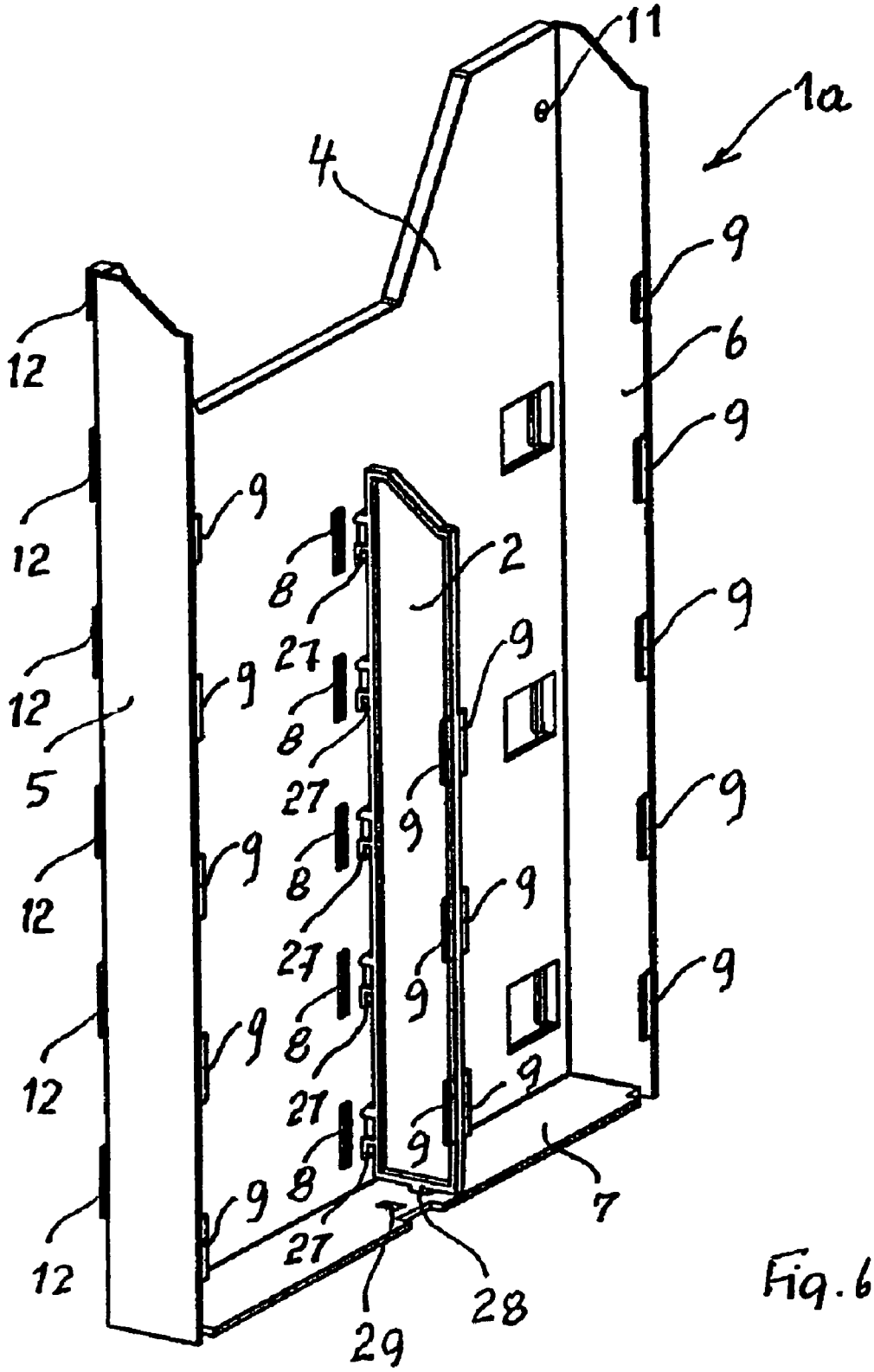

Details of the partition wall 2 and fitting it to the rear wall 4 of the tray 1*a* in FIG. 1 can be taken from FIG. 6. As can be seen, the partition wall 2 is provided at its lower edge with hooks 27 which can be inserted into the longitudinal slots 8. In the inserted state a clip 28 locks into a recess 29 in the end wall 7. On its edge facing away from the hooks 27 also the partition wall 2 has lug-shaped protrusions 9, which together with the protrusions 9 on the side walls 5, 6 facilitate the connection of the additional tray 3 having a reduced filling volume for the acceptance of sheet material with a smaller format. As shown in FIG. 6, the protrusions 9 are arranged on an edge of the partition wall, this edge being arranged opposite the hooks 27. The width of the additional trays 3 is in the illustrated case equal to half the width of the tray 1. If the rear walls 4 are provided with several rows of longitudinal slots 8, then with appropriately adapted additional trays other divisions can also be realised.

Figure 7:
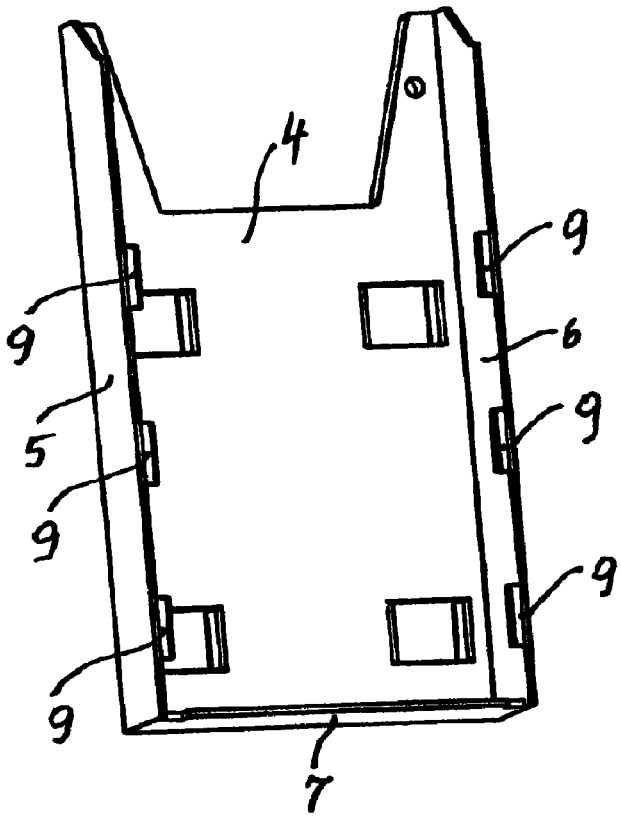
Figure 8:
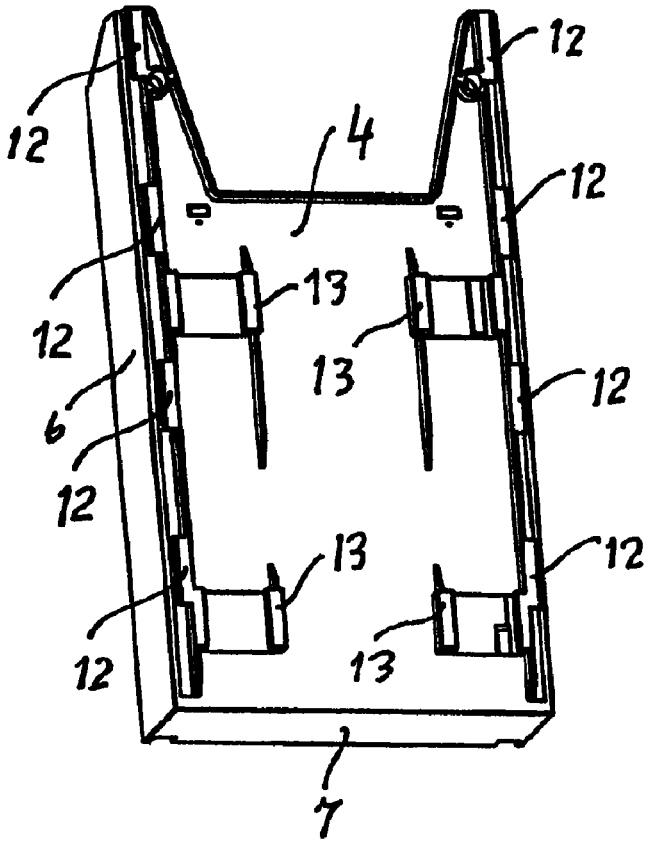
Figure 9:
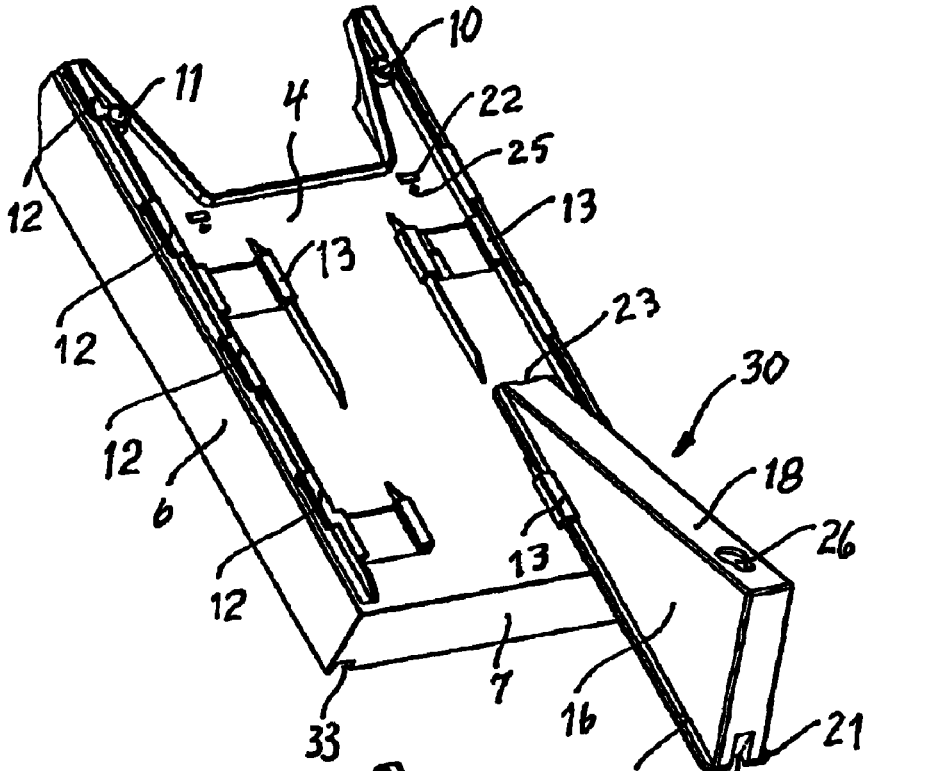
Figure 10:
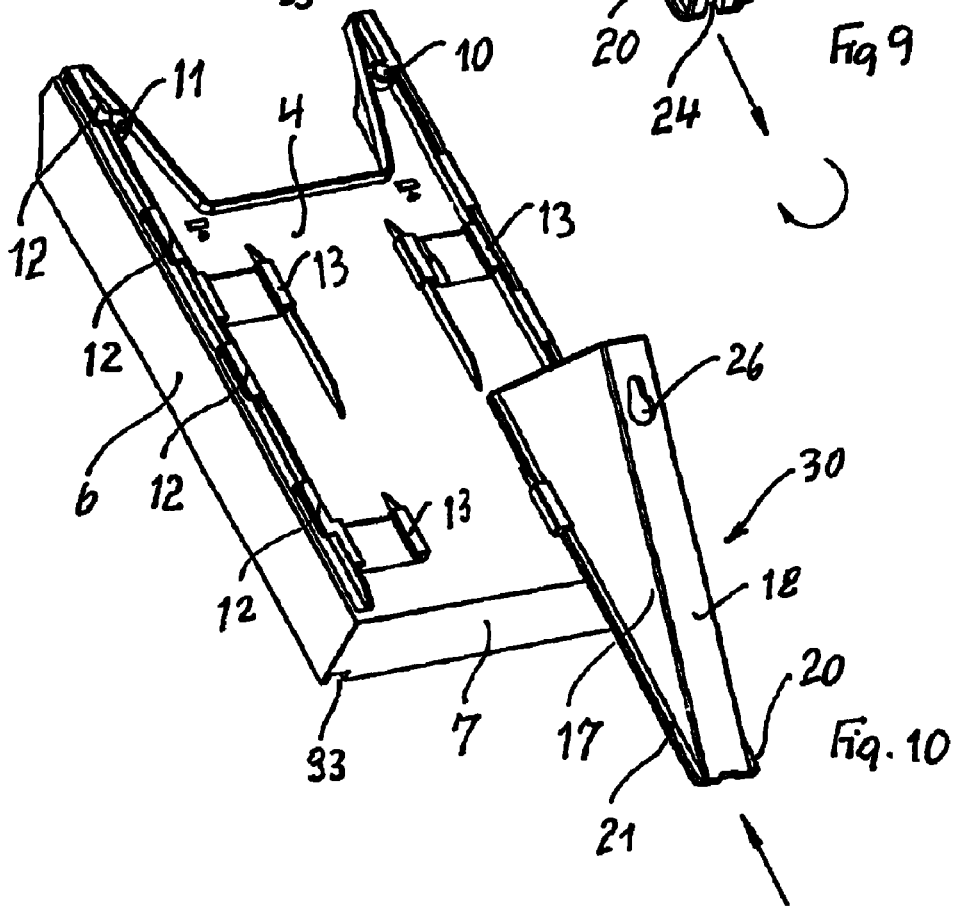

As can be seen from FIGS. 7 and 8, the construction of the additional trays 3 essentially corresponds to the construction of the tray 1. For parts corresponding to one another, the same reference numerals are therefore used. Due to the smaller dimensions of the additional trays 3 the number of protrusions 9, of mountings 12 and guides 13 of the additional trays 3 can be less than in the case of the tray 1. The dimensions of the above mentioned parts and their spacing to one another however match the dimensions of the corresponding parts of the tray 1 and their spacing to one another.

Based on the identical basic construction of the trays 1 and the additional trays 3, it is possible to configure a sheet material dispenser which only consists of the additional trays 3. In such a case it is recommended however that the component 15 illustrated in FIGS. 4 and 5 is replaced by a component 30 which has similarly reduced dimensions and which is provided with only a single hole 26.

Figure 11:
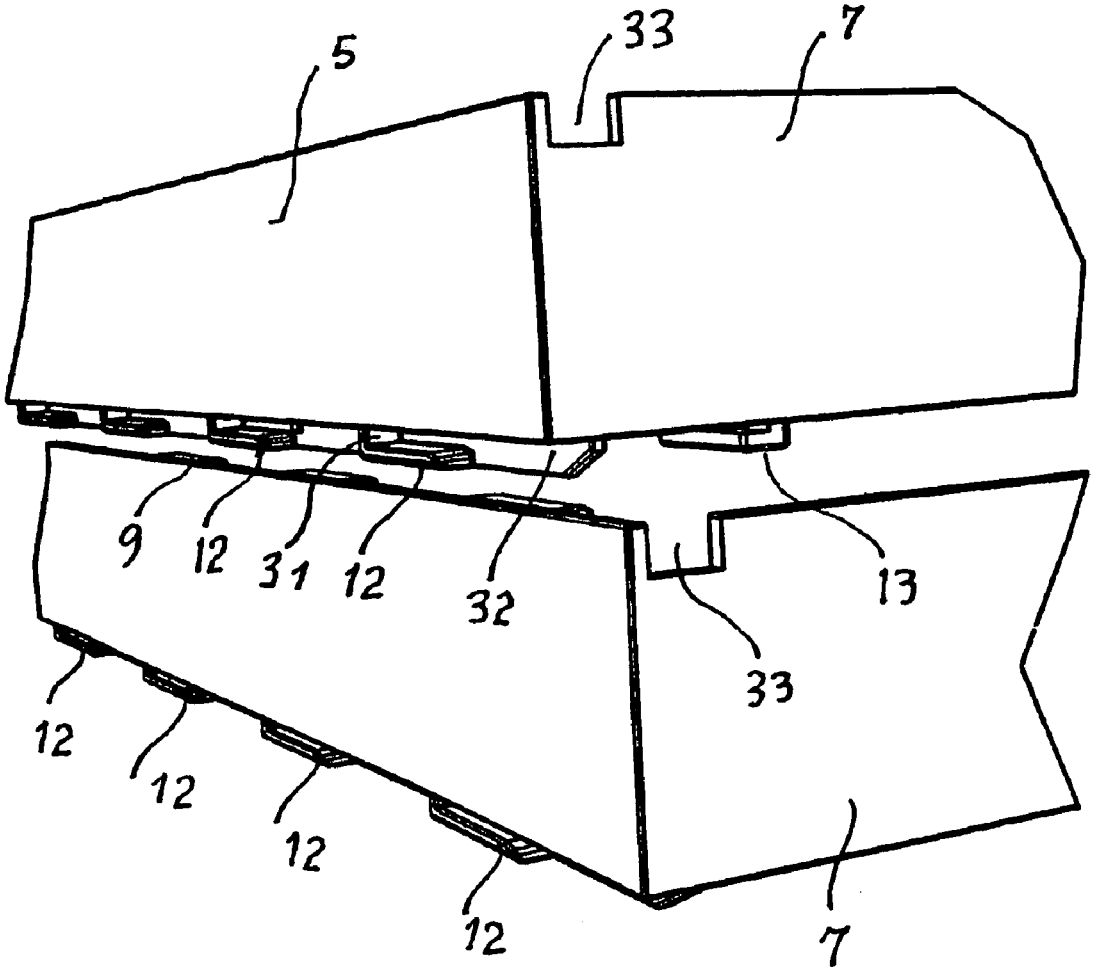

As can be seen best in FIG. 11, the mountings 12 are open at their outer sides and their ends facing the end wall 7, whereas the ends facing away from the end wall 7 are closed and form the limit stops 31 which limit the insertion movement of the protrusions. Through a longitudinal lug 32, which practically extends over the complete height of the trays 1 or of the additional trays 3, the mountings 12 are similarly closed on their internal side. In other words, they form open pocket-like receptacles on two sides. To prevent the longitudinal lugs 32 from hitting the end wall 7 when fitting the trays 1 and the additional trays 3 together, the latter are provided with recesses 33.

Figure 12:
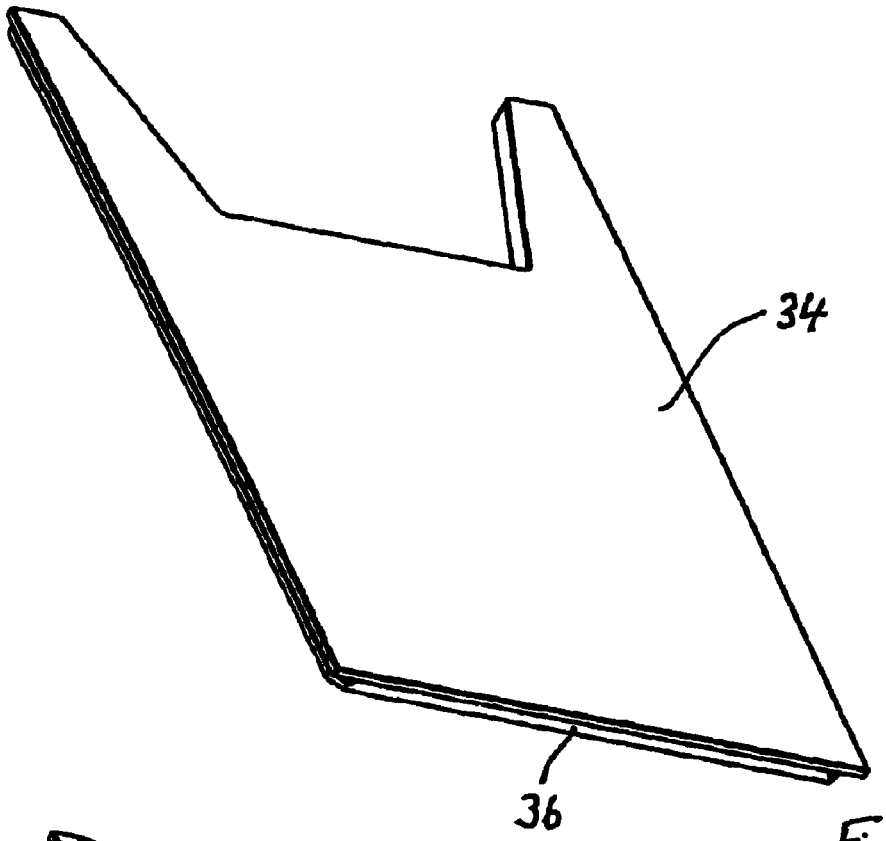
Figure 13:
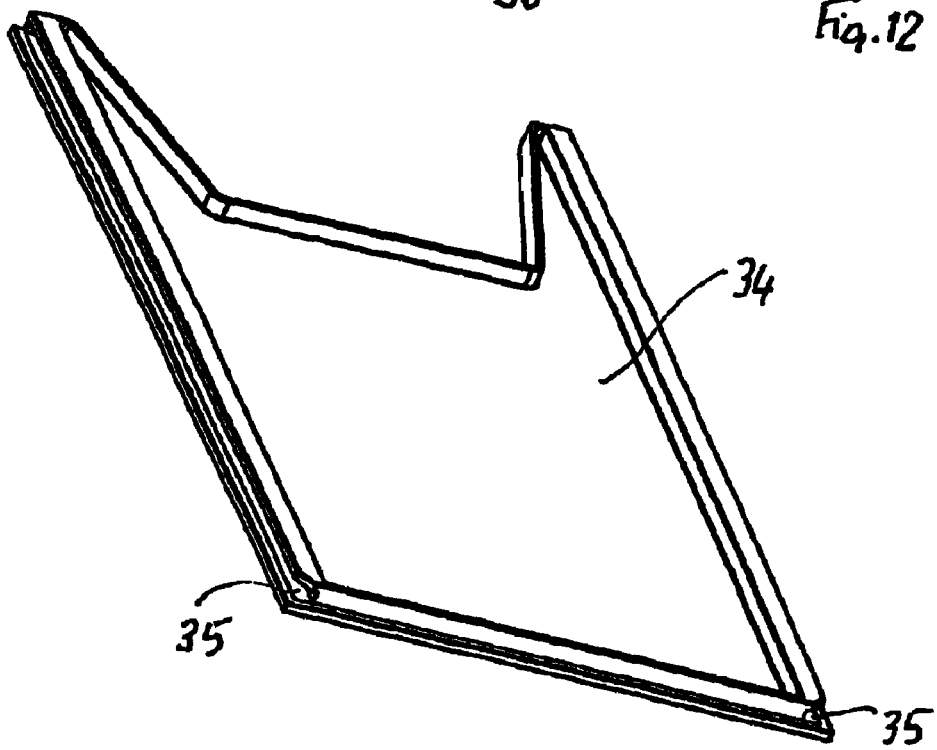

Of course, each of the front trays 1 or additional trays 3 must be provided with a cover formed from a front plate 34 on their front side. As can be seen from FIGS. 12 and 13, the front plate 34 is provided with grooves 35 in the region of its side edges and at its lower edge with a transverse strip 36 which forms a limit stop and which contacts the inner side of the end wall 7 with the sheet material dispenser in the assembled state.

Figure 14:
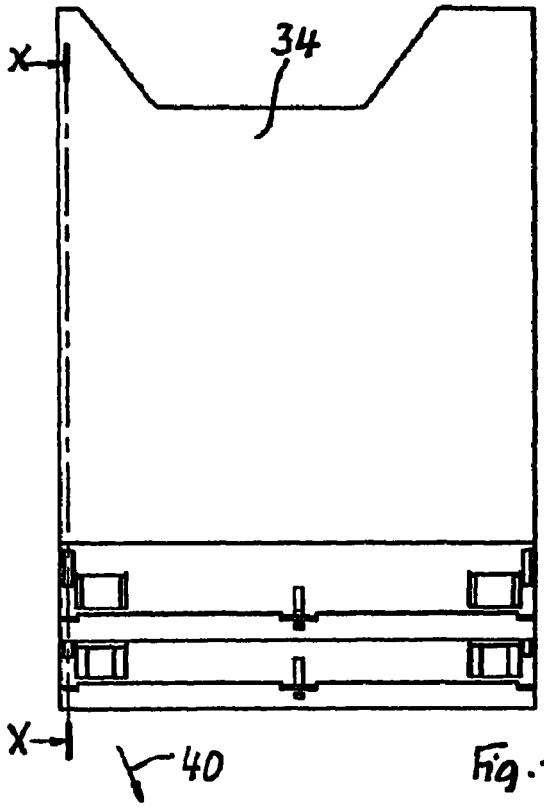
Figure 15:
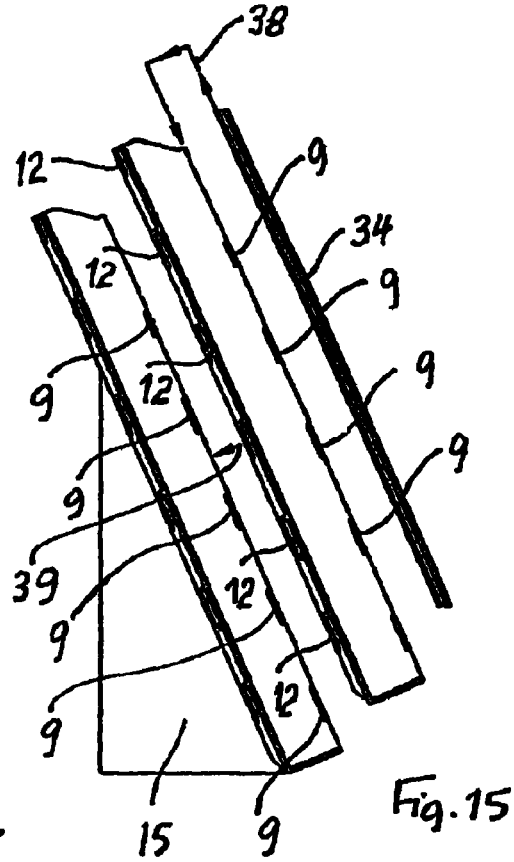
Figure 16:
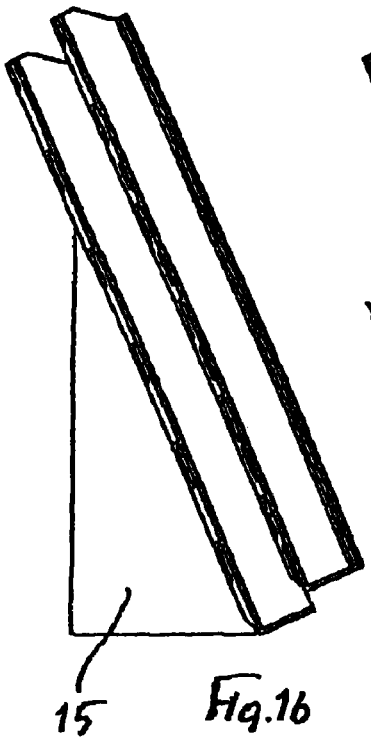
Figure 17:
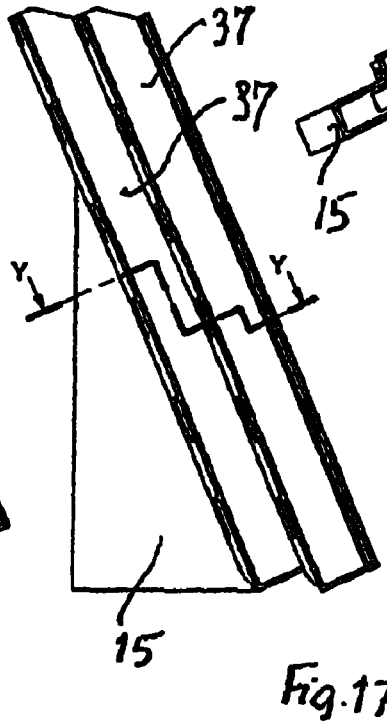
Figure 18:
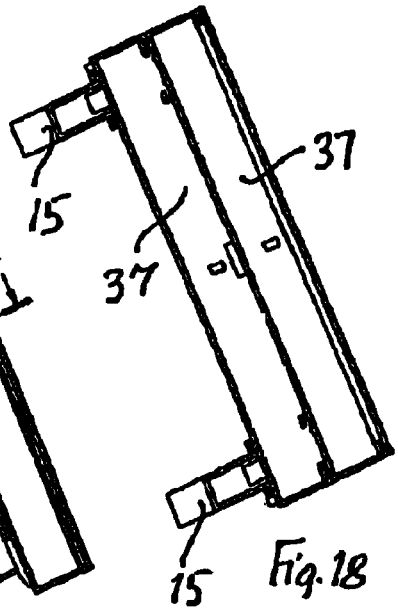

The assembly of a sheet material dispenser having two compartments 37 formed from two trays 1 is explained in the following based on FIGS. 14 to 17. FIG. 14 illustrates the front view of the two trays 1 and a front plate 34 as well as the sectioning line X-X of the sections illustrated in FIGS. 15 to 17. In the course of the assembly of the parts—as indicated by the arrow sequence 38—first the front plate 34 is pushed from above over the protrusions 9 of the front tray 1 until its transverse strip 36 (cf. FIGS. 12 and 13) contacts the inner side of the end wall 7. Then the front tray 1 is moved perpendicularly to the rear wall 4 of the rear tray 1 in the direction of the arrow 39 until the trays 1 take up the position illustrated in FIG. 16 in which the mountings 12 are aligned with the protrusions 9. Now the front tray 1 is pushed in the direction of the arrow 40 parallel to the rear wall 4 of the rear tray 1 until the position illustrated in FIG. 17 is reached. FIG. 18 illustrates a section along the line Y-Y in FIG. 17 through the assembled parts.

Figure 19:
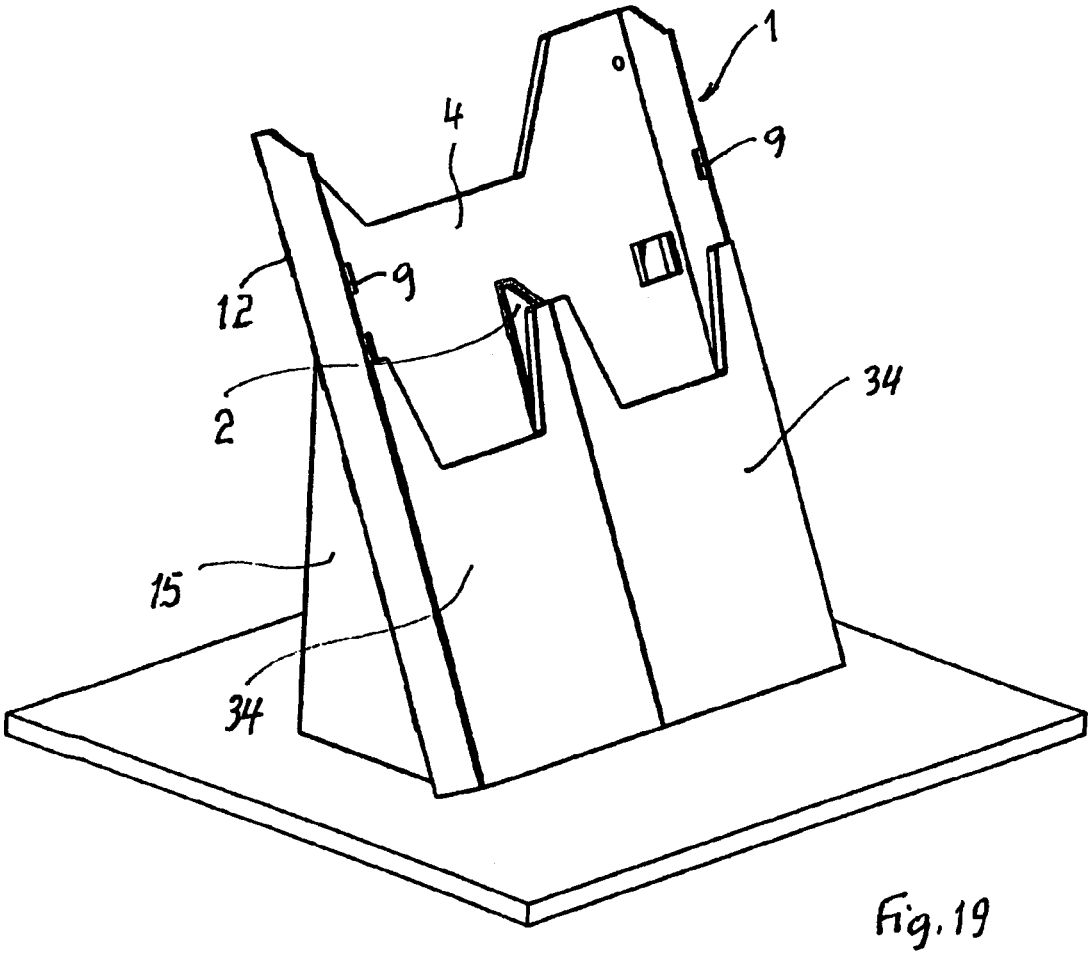

The sheet material dispenser illustrated in FIG. 19 consists of only one tray 1, which is divided by a partition wall 2 into two compartments.

The invention claimed is:

1. Sheet material dispenser, with at least two compartments (37) for accepting sheet material, in which the compartments (37) are formed by module components which can be joined together and released again, the module components including at least one or more trays (1) for accommodating sheet material, at least one front plate (34) and at least one partition wall (2), the tray (1) consisting of a rear wall (4), two side walls (5, 6) and an end wall (7) forming its lower end, and the tray (1) being provided with longitudinal slots (8) in the region of its rear wall (4) for the attachment of the partition wall (2), which has hooks (27) that can be inserted into the longitudinal slots (8), and by means of the partition wall (2) said tray can be divided, characterised in that the partition wall (2) has on its edge opposite of the hooks (27) protrusions (9), the protrusions (9) being directed towards the side walls (5, 6), and in that the protrusions (9) of the partition wall (2) together with protrusions (9) of the side walls (5, 6) facilitate the connection of additional trays (3) having a reduced filling volume, which also consist of a rear wall (4), two side walls (5, 6) and an end wall (7) forming their lower end and the width of which essentially corresponds to the spacing between the partition wall (2) and the respective side wall (5 or 6) facing it.

2. Sheet material dispenser, with at least two compartments (37) for accepting sheet material, in which the compartments (37) are formed by module components which can be joined together and released again, the module components including at least one tray (1) for accommodating sheet material, at least one front plate (34) and at least one partition wall (2), the tray (1) consisting of a rear wall (4), two side walls (5, 6) and an end wall (7) forming its lower end, and the tray (1) being provided with longitudinal slots (8) in the region of its rear wall (4) for the attachment of the partition wall (2), which has hooks (27) that can be inserted into the longitudinal slots (8), and by means of the partition wall (2) said tray can be divided, wherein the partition wall (2) has on its edge facing away from the hooks (27) protrusions (9), the protrusions (9) being directed towards the side walls (5, 6), characterised in that protrusions (9) of the partition wall (2) together with the protrusions (9) of the side walls (5, 6) facilitate the connection of additional trays (3) having a reduced filling volume, which also consist of a rear wall (4), two side walls (5, 6) and an end wall (7) forming their lower end and the width of which essentially corresponds to the spacing between the partition wall (2) and the respective side wall (5 or 6) facing it.

3. Sheet material dispenser according to claim 2, characterised in that the lower end of the partition wall (2) has a clip (28), which with the partition wall (2) inserted into the longitudinal slots (8) engages a recess (29) in the end wall (7) of the tray (1) joined to the partition wall (2).

4. Sheet material dispenser according to claim 3, characterised in that the tray (1) has in each case in the region of the edges of its side walls (5, 6) facing away from its rear wall (4) at least one protrusion (9) directed to the tray interior, that on the rear side of the rear wall (4) of each tray at least two mountings (12) are provided for accepting the protrusions (9) of a further tray (1) which can be joined to the tray (1) and that a limit stop (31) is provided for limiting the movement, directed parallel to the rear wall, of the trays (1) which can be respectively joined together.

5. Sheet material dispenser according to claim 2, characterised in that the tray (1) has in each case in the region of the edges of its two side walls (5, 6) facing away from its rear wall (4) at least one protrusion (9) directed to the tray interior, that on the rear side of the rear wall (4) of each tray at least two mountings (12) are provided for accepting the protrusions (9) of a further tray (1) which can be joined to the tray (1) and that a limit stop (31) is provided for limiting the movement, directed parallel to the rear wall, of the trays (1) which can be respectively joined together.

6. Sheet material dispenser according to claim 2, characterised in that the additional trays (3) are provided with mountings (12) on the rear side of their rear wall (4), which each have a limit stop (31) for limiting the movement parallel to the rear wall of the additional trays (3) respectively joined together.

7. Sheet material dispenser according to claim 2, characterised in that each side wall (5, 6) of said at least one or more trays (1) and the additional trays (3) are provided with at least two protrusions (9), arranged spaced from one another and directed to the tray interior.

8. Sheet material dispenser according to claim 2, characterised in that each side wall (5, 6) of said at least one or more trays (1) and the additional trays (3) are provided with more than three protrusions (9), arranged spaced from one another and directed to the tray interior.

9. Sheet material dispenser according to claim 8, characterised in that the spacing between the protrusions (9) of said at least one or more trays (1) or the additional trays (3) is equal to the spacing between the mountings (12) of said at least one or more trays (1) or the additional trays (3).

10. Sheet material dispenser according to claim 2, characterised in that in the region of the margins of the rear side of the rear wall (4) of said at least one or more trays (1) and the additional trays (3) at least two mountings (12) are respectively arranged.

11. Sheet material dispenser according to claim 10, characterised in that the spacing between the protrusions (9) of said at least one or more trays (1) or the additional trays (3) is equal to the spacing between the mountings (12) of the trays (1) or the additional trays (3).

12. Sheet material dispenser according to claim 8, characterised in that the mountings (12) consist of receptacles which are open at their outer sides and at their lower end.

13. Sheet material dispenser according to claim 12, characterised in that the rear sides of the rear walls (4) of said at least one or more trays (1) or the additional trays (3) in the vicinity of the side walls (5, 6) of said at least one or more trays (1) or the additional trays (3) are provided with parallel guides (13) for setting up or suspending components (15, 30).

14. Sheet material dispenser according to claim 13, characterised in that the guides (13) are formed L-shaped.

15. Sheet material dispenser according to claim 14, characterised in that the components (15, 30) have two side walls (16, 17) in the shape of a right-angled triangle, spaced from one another, which in the region of the limbs of the triangle are connected together by transverse walls (18, 19) and which have guide strips (20, 21) in the region of the hypotenuse of the triangle.

16. Sheet material dispenser according to claim 13, characterised in that the components (15, 30) have two side walls (16, 17) in the shape of a right-angled triangle, spaced from one another, which in the region of the limbs of the triangle are connected together by transverse walls (18, 19) and which have guide strips (20, 21) in the region of the hypotenuse of the triangle.

17. Sheet material dispenser according to claim 2, characterised in that on the rear side of the rear wall (4) of said at least one or more trays (1) and the additional trays (3) more than three mountings (12) are respectively arranged.

18. Sheet material dispenser according to claim 2, characterised in that the protrusions (9) are formed lug-shaped.

19. Sheet material dispenser according to claim 2, characterised in that it has at least one front plate (34) with guide grooves (35) which can be pushed over protrusions (9) of the additional tray (3).

20. Sheet material dispenser according to claim 19, characterised in that the front plate (34) is fitted with a limit stop (36) which can be brought into contact with the end wall (7) of the additional tray (3) to which it is joined.

21. Sheet material dispenser according to claim 2, characterised in that it has at least one front plate (34) with guide grooves (35) which can be pushed over the protrusions (9) of the respective tray (1).

22. Sheet material dispenser according to claim 21, characterised in that the front plate (34) is fitted with a limit stop (36) which can be brought into contact with the end wall (7) of the tray (1) to which it is joined.

* * * * *

UNITED STATES PATENT AND TRADEMARK OFFICE

CERTIFICATE OF CORRECTION

PATENT NO. : 7,909,182 B2
APPLICATION NO. : 11/977449
DATED : March 22, 2011
INVENTOR(S) : Horst-Werner Maier-Hunke It is certified that error appears in the above-identified patent and that said Letters Patent is hereby corrected as shown below:

Claim 12, Line 1 (Column 6, Line 14): Delete “claim 8” and substitute --claim 10--.

Signed and Sealed this
Tenth Day of May, 2011

David J. Kappos

David J. Kappos
*Director of the United States Patent and Trademark Office*